US008263914B2

(12) United States Patent
Clark

(10) Patent No.: US 8,263,914 B2
(45) Date of Patent: Sep. 11, 2012

(54) CARTRIDGE HEATER AND METHOD OF USE

(75) Inventor: Roger F. Clark, Knoxville, MD (US)

(73) Assignee: AMG IdealCast Corporation, Frederick, MD (US)

( * ) Notice: Subject to any disclaimer, the term of this patent is extended or adjusted under 35 U.S.C. 154(b) by 572 days.

(21) Appl. No.: 12/547,572

(22) Filed: Aug. 26, 2009

(65) Prior Publication Data

US 2010/0051601 A1 Mar. 4, 2010

Related U.S. Application Data

(60) Provisional application No. 61/161,096, filed on Mar. 18, 2009, provisional application No. 61/092,186, filed on Aug. 27, 2008.

(51) Int. Cl.
*H05B 1/00* (2006.01)

(52) U.S. Cl. ..... 219/553; 219/409; 219/426; 219/435; 219/436; 219/523; 219/536; 219/541; 219/546; 373/128; 373/133; 373/134

(58) Field of Classification Search ..... 219/408–410, 219/426, 427, 536, 538, 541–544, 552, 553; 373/127, 128, 133, 134
See application file for complete search history.

(56) References Cited

U.S. PATENT DOCUMENTS

| | | | | |
|---|---|---|---|---|
| 715,505 | A * | 12/1902 | Potter | 373/118 |
| 3,171,871 | A | 3/1965 | Watson et al. | |
| 4,090,054 | A * | 5/1978 | Heine et al. | 219/632 |
| 4,118,197 | A | 10/1978 | Mackintosh et al. | |
| 4,335,081 | A | 6/1982 | Sachs et al. | |
| 4,475,029 | A * | 10/1984 | Yoshida et al. | 219/270 |
| 4,848,616 | A * | 7/1989 | Nozaki | 204/196.11 |
| 6,676,381 | B2 * | 1/2004 | Subramanian et al. | 416/241 B |

FOREIGN PATENT DOCUMENTS

| | | |
|---|---|---|
| CA | 2 132 401 | 7/2004 |
| GB | 1 222 465 | 2/1971 |

* cited by examiner

*Primary Examiner* — Fernando L Toledo
*Assistant Examiner* — Bryan Junge
(74) *Attorney, Agent, or Firm* — Thomas McWilliams; Edward F. Behm

(57) ABSTRACT

This invention relates to an electric cartridge heater and a method of operation, suitable for use in producing high purity silicon in solar cells or solar modules. The apparatus includes a single-piece elongated heater bar having a length, a first end, and a second end. The apparatus also includes a slot beginning at the first end and running a portion of the length, and the slot dividing the heater bar into a first arm and a second arm. An elbow at the second end joins the first arm and the second arm together. The apparatus also includes a first electrode in electrical communication with the first arm, and a second electrode in electrical communication with the second arm.

27 Claims, 2 Drawing Sheets

CARTRIDGE HEATER AND METHOD OF USE

This application claims the benefit of U.S. Provisional Application No. 61/161,096, filed on Mar. 18, 2009, and U.S. Provisional Application No. 61/092,186, filed Aug. 27, 2008, the entirety of both are expressly incorporated herein by reference.

BACKGROUND

1. Technical Field

This invention relates to an electric cartridge heater and a method of operation, suitable for use in producing high purity silicon in solar cells or solar modules.

2. Discussion of Related Art

Conventional heater designs suffer from cost issues and failure modes related to a very complex design and assembly of many small parts. A known heater design for use in silicon casting furnaces has a single large serpentine heater that is machined out of a large block. The complex machining is costly to fabricate and great care is used while handling the resulting shape to avoid breakage. Another known heater design for use in silicon casting furnaces has many or even hundreds of bolted connections. The bolted connections are expensive and time consuming to assemble while providing multiple possible failure points.

SUMMARY

This invention relates to a cartridge heater and a method of operation, suitable for use in producing high purity silicon in solar cells or solar modules. The heater warms up an inside contents of a furnace or a casting station to at least about 1,412 degrees Celsius (melting point of silicon) under or in an inert atmosphere or environment. The cartridge heater assembly of this invention includes a reliable design with ease of manufacture, while allowing a heater element to be replaced without entering the furnace, such as during the casting process.

According to a first embodiment, this invention relates a heating apparatus suitable for use in producing high purity silicon. The apparatus includes a single-piece elongated heater bar having a length, a first end, and a second end. The apparatus also includes a slot beginning at the first end and running a portion of the length, and the slot dividing the heater bar into a first arm and a second arm. An elbow at the second end joins the first arm and the second arm together allowing all electrical connections to be made at the first end. The apparatus also includes a first electrode in electrical communication with the first arm, and a second electrode in electrical communication with the second arm.

According to a second embodiment, this invention relates to a heating apparatus suitable for use in casting high purity silicon. The apparatus includes a monolithic (single-piece) graphite elongated heater bar having a length, a first end with a generally rectangular taper-lock terminal, a second end opposite the first end, and a diameter of between about 10 centimeters to about 15 centimeters. The apparatus also includes a slot across the diameter beginning at the first end and running a portion of the length, and the slot dividing the heater bar into a first arm and a second arm. An elbow at the second end joins the first arm and the second arm together. The apparatus also includes 5 longitudinal slits along each a portion of a length of the first arm and a length of the second arm. The apparatus includes a first electrode with a first hairpin water-filled electrical conductor in electrical communication with the first arm by a tapered fit with the terminal, and a second electrode with a second hairpin water-filled electrical conductor in electrical communication with the second arm by a tapered fit with the terminal. The apparatus also includes a first compression plate securing the first arm and the first electrode, and a second compression plate securing the second arm and the second electrode. The apparatus also includes an insulating insert disposed between the first arm and the second arm at the first end of the elongated heater bar, and an insulating sleeve disposed over a portion of the elongated heater bar near the first electrode and the second electrode and isolating the heater bar from furnace insulation layers.

According to a third embodiment, this invention relates to a method of heating a furnace volume suitable for use in producing high purity silicon. The method includes the step, of supplying an electrical current from an electrical source through a first electrical conductor, and the step of flowing the electrical current from the electrical conductor through a first electrode. The method also includes the step of flowing the electrical current from the first electrode through a first arm of a single-piece elongated heater bar and resistance heating at least a portion of the furnace volume, and the step of flowing the electrical current from the first arm through an elbow of the elongated heater bar. The method also includes the step of flowing the electrical current from the elbow through a second arm of the elongated heater bar and resistance heating at least a portion of the furnace volume, and the step of flowing the electrical current from the second arm through a second electrode. The invention also includes the step of flowing the electrical current from the second electrode through a second electrical conductor.

According to a fourth embodiment, this invention relates to a method of operating a furnace heater, suitable for use in producing high purity silicon. The method includes the step of energizing a heater element to heat a furnace volume with an electrical supply, and the step of operating the heater element until failure. The method includes the step of denergizing the electrical supply, and the step of removing a first compression plate on a first electrode. The method also includes the step of removing a second compression plate on a second electrode, and the step of removing a single-piece elongated heater bar from the furnace. The method also includes the step of inserting a second single-piece elongated heater bar into the furnace and the step of installing the first compression plate on the first electrode. The method also includes the step of installing the second compression plate on the second electrode, and the step of reenergizing the electrical supply.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention. In the drawings.

DETAILED DESCRIPTION

This invention relates to a cartridge heater and a method of use, suitable for use in producing high purity silicon in solar cells or solar modules. Each heater can be slip fit into a water-cooled bus that provides a taper-lock power connection and can be removed straight out, such as without entering the casting station. Desirably, the heater can be replaced during furnace operation without entering the furnace.

This invention includes the formation of a heater body from a relatively small diameter graphite piece (for low cost manufacture). The heater body can be machined into an efficient radiant heater shape and easily inserted into an electrical connection for use in heating a controlled atmosphere high temperature furnace.

The device of this invention can be used in several non-silicon applications or areas where high temperature controlled-atmosphere furnaces are used or employed in manufacturing, producing, calcining, refining, and/or processing materials, such as ceramics, refractories, metals, graphite, graphite composites, and/or the like.

Figure 1:
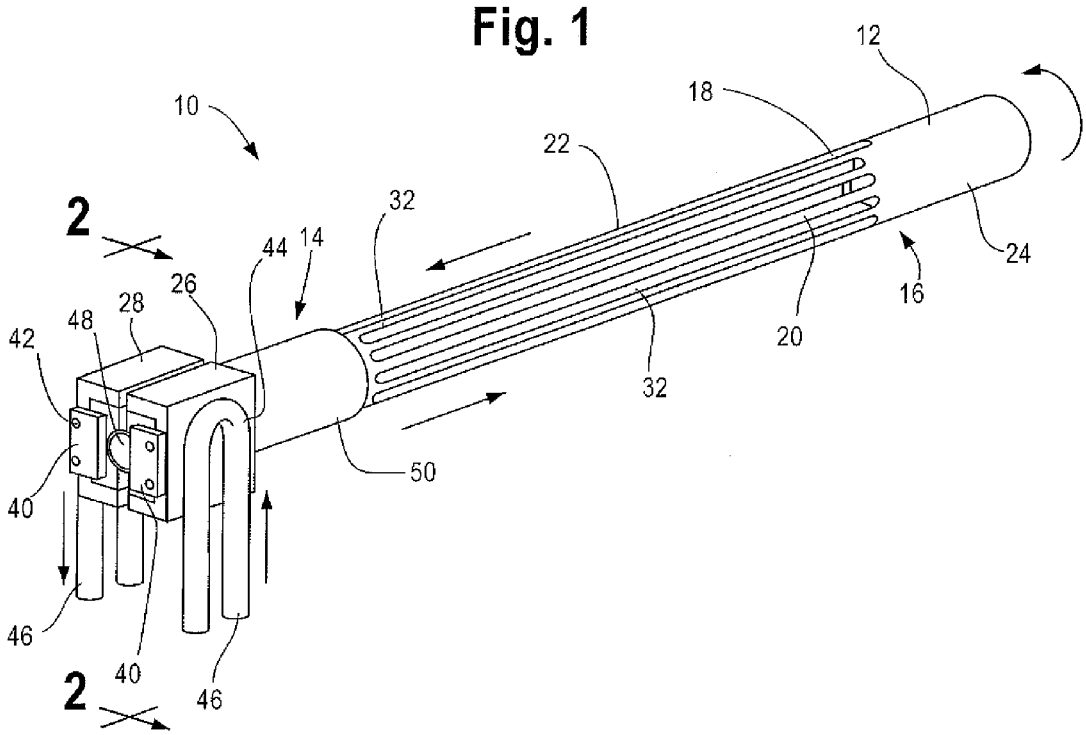
FIG. 1 illustrates an isometric view of a heating apparatus, according to one embodiment.

FIG. 1 shows an isometric view of a heating apparatus 10 according to one embodiment. The heating apparatus 10 includes an elongated heater bar 12 having a first end 14 and a second end 16. The elongated heating bar 12 includes a slot 18 along at least a length of the elongated heater bar 12. The slot 18 divides the elongated heater bar 12 into a first arm 20 and a second arm 22, such as a first part of a resistance heater or a current path and a second part of a resistance heater or a current path. The first arm 20 joins with the second arm 22 at or by the elbow 24. The elbow 24 may form a generally U-bend shape at or near the second end 16. The elbow 24 may include resistance heating characteristics or functions. The elongated heater bar 12 includes a plurality of slits 32 running a length of the elongated heater bar 12.

The first electrode 26 and the second electrode 28 supplies power or electrical current to and/or from the heating apparatus 10, such as by a water-filled electrical conductor 46 with a hairpin 44. Compression plates 40 hold the elongated heater bar 12 in contact with or against at least a portion of the electrodes 26 and 28. The compression plates 40 are secured with screws 42 in holes into the electrodes 26 and 28, such as the vertical sides. An insulating insert 48 helps to electrically separate the first arm 20 and the second arm 22, such as the insulating insert 48 can be inserted at or near the first end 14 of the elongated heater bar 12. An insulating sleeve 50 helps to electrically and/or thermally isolate the heating apparatus 10 from the insulation (not shown), such as positioned over a portion of the elongated heater bar 12 at or near the first end 14.

The directional arrows shown in FIG. 1 at least generally trace the flow of current through the heating apparatus 10.

Figure 2:
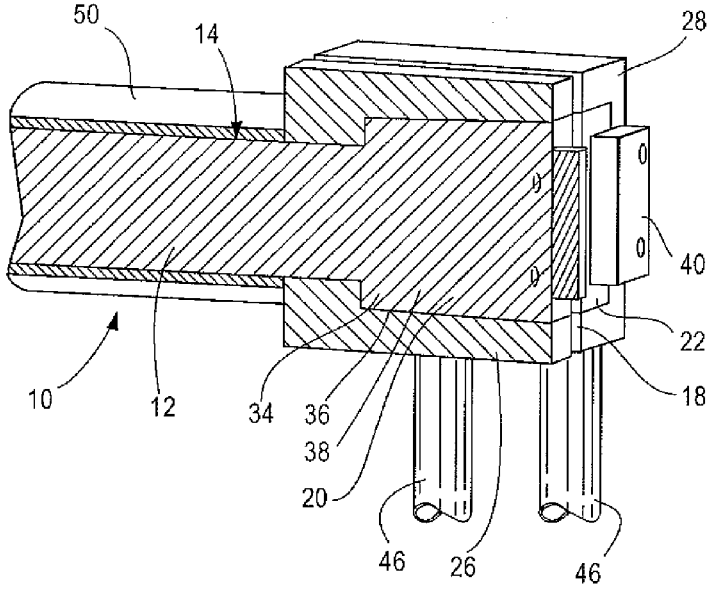
FIG. 2 illustrates a partial side sectional view of a heating apparatus, according to one embodiment.

FIG. 2 shows a partial side sectional view of the heating apparatus 10, according to one embodiment. The slot 18 divides the elongated heater bar 12 into the first arm 20 and the second arm 22. The insulating sleeve 50 can cover a portion of the elongated heater bar 12. The first end 14 of the elongated heater bar 12 includes an electrode interface 34, such as for passing current to and/or from the electrodes 26 and 28 by the water-filled electrical conductors 46. The electrode interface 34 may include a tapered fit 36, such as the tapered fit 36 becomes or gets tighter upon further insertion of the elongated heater bar 12. Desirably, the tapered fit 36 increases in dimension in a direction toward the tip of the first end 14. A portion of the elongated heater bar 12 may form a generally rectangular taper-lock terminal 38, such as for connecting with the electrodes 26 and 28. The compression plates 40 may secure, engage, and/or hold the generally rectangular taper-lock terminal 38.

Figure 3:
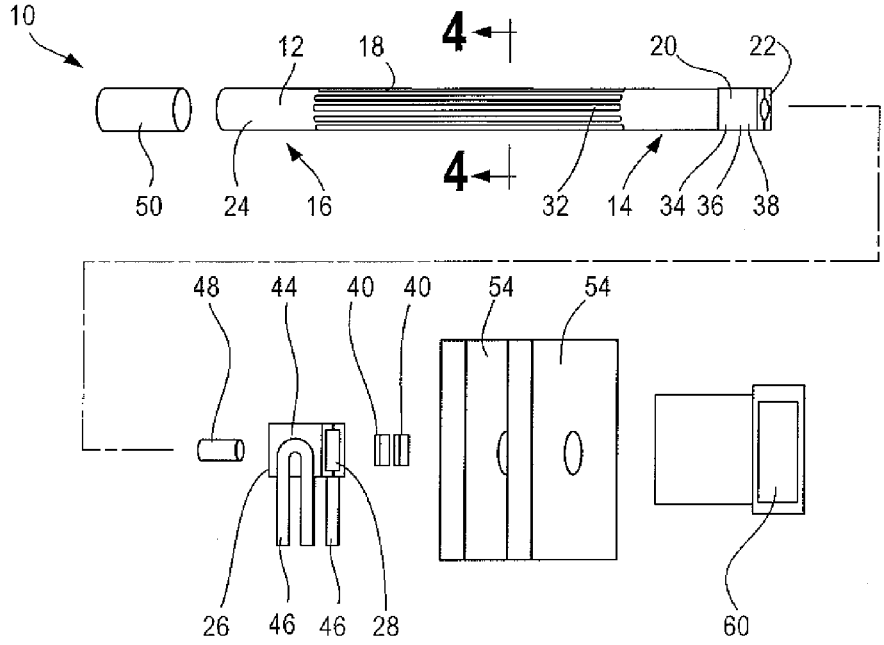
FIG. 3 illustrates a partially exploded view of a heating apparatus according to one embodiment.

FIG. 3 shows a partially exploded view of the heating apparatus 10, according to one embodiment. The elongated heater bar 12 passes through and into the electrical bus connection with the first electrode 26 and the second electrode 28, such as from the outside of the furnace (not shown). The second end 16 passes through insulation layers 54 to allow the first end 14 to contact with the electrical bus. The slot 18 divides the elongated heater bar 12 into the first arm 20 and the second arm 22 which are connected by the elbow 24. The first arm 20 and the second arm 22 include five slits 32 each. The electrode interface 34 includes a tapered fit 36 for forming the generally rectangular taper-lock terminal 38 at the first end 14, such as corresponding to a shape of the electrodes 26 and 28. The compression plates 40 secure the elongated heater bar 12 to the electrodes 26 and 28 to allow the water-filled electrical conductor 46 with the hairpin 44 to supply electrical current. The insulating insert 48 separates the first arm 20 and the second arm 22. The insulating sleeve 50 isolates the elongated heater bar 12 from the insulation layers 54. The cover box 60 provides protection to the electrical bus, such as to prevent accidental contact across the positive and negative terminals of the heating apparatus 10. Desirably, by mounting the cover box 60 against and/or to the insulation layers 54 or the furnace structural members (not shown) safety may be ensured.

Figure 4:
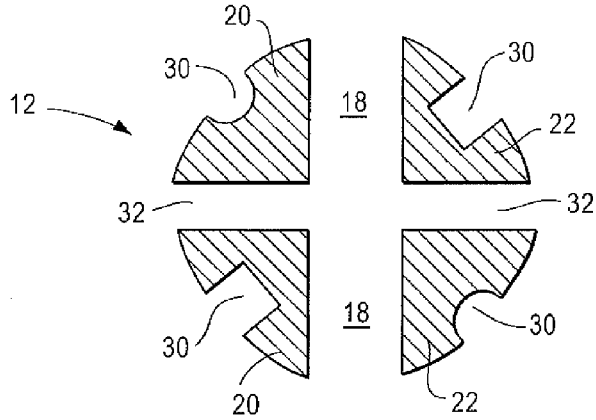
FIG. 4 illustrates a partial side sectional view of a heater bar, according to one embodiment.

FIG. 4 shows a partial cross sectional view of the elongated heater bar 12, according to one embodiment. The slot 18 divides the first arm 20 from the second arm. The slits 32 go from the outside of the arms 20 and 22 to the inside (through). In contrast, the grooves 30 do not go all the way through a thickness of the arms 20 and 22. Some grooves 30 include a semicircular shape and other grooves 30 include a rectangular shape. Other shapes for grooves 30 are possible.

Figure 5:
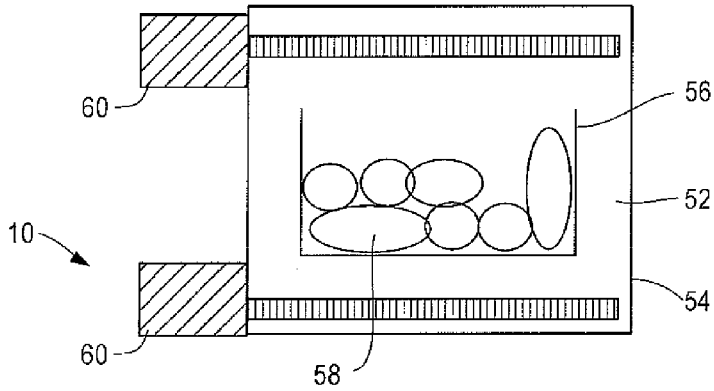
FIG. 5 illustrates a partial side sectional view of a furnace, according to one embodiment.

FIG. 5 shows a partial cross sectional view of the heating apparatus 10 with a cover box 60 installed or positioned on or in a furnace 52. The furnace 52 includes insulation layers 54 and a crucible 56 for holding or containing feedstock 58, such as silicon.

Moreover, although casting of silicon has been described herein, other semiconductor materials and nonmetallic crystalline materials may be cast without departing from the scope and spirit of the invention. For example, the inventor has contemplated casting of other materials consistent with embodiments of the invention, such as germanium, gallium arsenide, silicon germanium, aluminum oxide (including its single crystal form of sapphire), gallium nitride, zinc oxide, zinc sulfide, gallium indium arsenide, indium antimonide, germanium, yttrium barium oxides, lanthanide oxides, magnesium oxide, calcium oxide, and other semiconductors, oxides, and intermetallics with a liquid phase. In addition, a number of other group III-V or group II-VI materials, as well as metals and alloys, could be cast according to embodiments of the present invention.

High purity silicon refers broadly to silicon that has been at least partially refined to reduce an amount of impurities, such as carbon, silicon carbide, silicon nitride, oxygen, metals, other substances that may reduce an efficiency of a solar cell or a solar module, and/or the like. According to one embodiment, high purity silicon contains less or fewer impurities than metallurgical grade silicon. The high purity silicon may include a carbon concentration of about $2\times10^{16}$ atoms/centimeter cubed to about $5\times10^{17}$ atoms/centimeter cubed, an oxygen concentration not exceeding $7\times10^{17}$ atoms/centimeter cubed, and a nitrogen concentration of at least $1\times10^{15}$ atoms/centimeter cubed, for example.

The high purity silicon may include primarily multicrystalline silicon, monocrystalline silicon, near monocrystalline silicon, geometric multicrystalline silicon, and/or the like. The high purity silicon may further be substantially free from radially distributed defects, such as made without the use of rotational processes.

Cast silicon includes multicrystalline silicon, near multicrystalline silicon, geometric multicrystalline silicon, and/or monocrystalline silicon. Multicrystalline silicon refers to crystalline silicon having about a centimeter scale grain size distribution, with multiple randomly oriented crystals located within a body of multicrystalline silicon.

Geometric multicrystalline silicon or geometrically ordered multicrystalline silicon refers to crystalline silicon having a nonrandom ordered centimeter scale grain size distribution, with multiple ordered crystals located within a body of multicrystalline silicon. The geometric multicrystalline may include grains typically having an average about 0.5 centimeters to about 5 centimeters in size and a grain orientation within a body of geometric multicrystalline silicon can be controlled according to predetermined orientations, such as using a combination of suitable seed crystals.

Polycrystalline silicon refers to crystalline silicon with micrometer to millimeter scale grain size and multiple grain orientations located within a given body of crystalline silicon. Polycrystalline silicon may include grains typically having an average of about submicron to about micron in size (e.g., individual grains are not visible to the naked eye) and a grain orientation distributed randomly throughout.

Monocrystalline silicon refers to crystalline silicon with very few grain boundaries since the material has generally and/or substantially the same crystal orientation. Monocrystalline material may be formed with one or more seed crystals, such as a piece of crystalline material brought in contact with liquid silicon during solidification to set the crystal growth. Near monocrystalline silicon refers to generally crystalline silicon with more grain boundaries than monocrystalline silicon but generally substantially fewer than multicrystalline silicon.

According to one embodiment, this invention may include a heating apparatus suitable for use in producing high purity silicon. The apparatus may include a single-piece elongated heater bar having a length, a first end, and a second end. The apparatus may also include a slot beginning at the first end and running a portion of the length, and the slot dividing the heater bar into a first arm and a second arm. The apparatus may also include an elbow at the second end joining the first arm and the second arm together allowing all electrical connections to be made at the first end. The apparatus may also include a first electrode in electrical communication with the first arm, and a second electrode in electrical communication with the second arm.

Single-piece refers broadly to a generally unitary structure, such as without joints, seams, unions, or including more than one part. Elongated refers broadly to having a length longer than a width or a diameter. Desirably, the length includes at least about 5 times a width or a diameter, at least about 10 times a width or a diameter, at least about 25 times a width or a diameter, at least about 50 times a width or a diameter, and/or the like.

Heater refers broadly to a device that can increase a temperature or internal energy of at least a portion of a surroundings, such as by convection, conduction, radiation, and/or the like. The heater can warm or raise a temperature above about ambient conditions, above at least about 500 degrees Celsius, above at least about 1000 degrees Celsius, about at least about 1412 degrees Celsius (melting point of silicon), about at least about 1500 degrees Celsius, and/or the like. The heater may operate solely through resistance heating.

Resistance heating broadly refers to the generation of heat by electric conductors carrying current. The degree of heating for a given current may be at least generally proportional to the electrical resistance of the conductor, such as a high resistance may generate a large amount of heat. Desirably, heating elements include high resistivity and can withstand high temperatures without deteriorating and/or sagging. Other desirable characteristics of resistance heaters may include a low temperature coefficient of resistance, low cost, formability, availability of materials, and/or the like. A protective oxide layer or coating may form on a surface of the heater upon use and inhibit or retard further oxidation. In the case of graphite and in use with silicon, a protective silicon carbide layer may form to inhibit or retard further oxidation, for example.

A bar or a rod refers to any generally elongated member. According to one embodiment, the bar may include any suitable cross section, such as generally circular, generally triangular, generally rectangular, generally square, generally hexagonal, generally octagonal, and/or the like.

The length of the bar may include any suitable distance, such as between about 10 centimeters and about 500 centimeters, between about 50 centimeters and about 300 centimeters, about 200 centimeters, and/or the like. A width and/or a diameter of the bar may include any suitable distance, such as between about 5 centimeters to about 25 centimeters, between about 10 centimeters to about 15 centimeters, about 12.5 centimeters, and/or the like.

The heater bar may include any suitable material, such as carbon, graphite, carbon-bonded carbon fiber, silicon carbide, nickel-chrome, molybdenum, tungsten, refractory metal silicides, and/or the like. The heater bar may be fabricated or constructed of any suitable number of one or more components or pieces. According to one embodiment, the elongated heater bar can be machined or fabricated from a monolithic block or cylinder, such as to form a single unitary piece or component. Monolithic broadly refers to being cast as a single piece and/or formed or composed of material without joints or seams.

The first end refers broadly to a tip or a location near or at the limit of the bar. The second end refers broadly to a tip or a location near or at the limit of the bar, such as at least generally opposite the first end and separated by a length of the bar. The second end may include a chamfered end or a beveled end. The second end may also include a recessed circle, a dimple, and/or the like.

The elbow broadly refers to a connection between the first arm and the second arm, such as with an at least generally somewhat U-shape, for example. The elbow may include any suitable length, such as between about 5 percent and about 35 percent of the length of the heater bar, between about 5 percent and about 20 percent of the length of the heater bar, about 15 percent of the length of the heater bar, and/or the like. The elbow may function at least in part as a resistance heater.

The slot broadly refers to a generally narrow passage, enclosure and/or the like. According to one embodiment, the slot extends at least generally parallel down and/or along at least a portion of the length of the heater bar. The slot at least generally divides the heater part into two or more portions, such as a first arm and a second arm. Desirably, the slot provides a gap broad and/or wide enough, such as not to have arcing and/or short circuiting between the arms during operation. The slot may define and/or limit the electrical current path, such as to form the two arms of the elongated heater bar. The slot may include any suitable width, such as between about 0.2 centimeters and about 2 centimeters, between about 0.5 centimeters and about 1 centimeter, and/or the like. The slot may be made by removing a portion of material from the starting block, using any of the suitable machining methods for the material of the heater bar. The slot may include a varying width, such as with a respect to a radius of the heater bar, for example.

According to one embodiment, the slot divides the elongated heater bar across a width or a diameter, such as across the widest dimension. The slot may include any suitable length, such as between about 10 percent and about 90 percent a length of the bar, between about 40 percent and about 80 percent a length of the bar, about 75 percent a length of the bar, and/or the like. The slot may include any suitable orientation, such as generally, vertical, generally horizontal, generally diagonal, and/or the like. Additionally, the slot may allow heat to flow from within the heater bar, for example.

The heater bar may include one or more grooves along a portion of the length. Grooves broadly refer to a long narrow channels and/or depressions. Grooves do not extend completely through a material as a slot or a slit may extend through a material. The heater bar may include any suitable number of grooves, such as at least about 1, at least about 2, at least about 3, at least about 4, about least about 5, at least about 6, at least about 10, at least about 20, and/or the like. According to one embodiment, the heater bar may include 5 grooves on each arm. The grooves may extend down and/or along any suitable length of the heater bar, such as between about 10 percent and about 90 percent a length of the bar, between about 40 percent and about 80 percent a length of the bar, about 70 percent a length of the bar. Desirably, the grooves have a shorter length than the length of the slot, such as by about 1 to about 2 widths of the slot near the second end.

The grooves may include any suitable width and/or depth, such as a width of about 1 to about 2 widths of the slot. The depth may include any suitable distance, such as about 1 times a width of the groove, about 2 times a width of the groove, about 5 times a width of the groove, and/or the like. According to one embodiment, the grooves can be used to provide an increased surface area, such as for improved heating. The grooves can be used to adjust the resistance of the heater bar, such as more grooves (less material) increase resistance. The grooves may be located and/or disposed at any suitable angle or position, such as generally equally spaced at about 20 degrees apart, at about 30 degrees apart, at about 45 degrees apart, and/or the like. The grooves may be made by removing a portion of material from the starting block, using any of the suitable machining methods for the material of the heater bar. The grooves may include any suitable shape, such as a generally arcuate shape, a generally triangular shape, a generally rectangular shape, a generally square shape, and/or the like.

The heater bar may include one or more slits or longitudinal slits along a portion of the length. Slits broadly refer to a long narrow cut and/or opening, such as to form an orifice or an aperture. Slits extend completely through a material as a groove may not extend through a material. The heater bar may include any suitable number of slits, such as at least about 1, at least about 2, at least about 3, at least about 4, about least about 5, at least about 6, at least about 10, at least about 20, and/or the like. According to one embodiment, the heater bar may include 5 slits on each arm. The slits may extend down and/or along any suitable length of the heater bar, such as between about 10 percent and about 90 percent a length of the bar, between about 40 percent and about 80 percent a length of the bar, about 70 percent a length of the bar. Desirably, the slits have a shorter length than the length of the slot, such as by about 1 to about 2 widths of the slot near the second end.

The slits may include any suitable width, such as a width of about 1 to about 2 widths of the slot. Varying a width of the slit with respect to a radius of the heater bar is within the scope of this invention, for example. The depth extends through the material of the heater bar, such as to the slot, for example. According to one embodiment, the slits can be used to provide an increased surface area, such as for improved heating. The slits can be used to adjust a resistance of the heater bar, such as more slits (less material) increase resistance. The slits may be located and/or disposed at any suitable angle or position, such as generally equally spaced at about 20 degrees apart, at about 30 degrees apart, at about 45 degrees apart, and/or the like. The slits may be made by removing a portion of material from the starting block, using any of the suitable machining methods for the material of the heater bar. The slits in combination with the slot may form a generally triangular or piece-of-pie shape cross section of the elongated heater bar, such as viewed generally transverse to the length. Additionally, the slits may allow heat to flow from within the heater bar, for example.

Combinations of slits and/or grooves are within the scope of this invention, such as alternating a slit and a groove for every other one.

The apparatus may include an electrical junction or contact, such as for connecting to an electrical supply and/or a current source. The first leg and the second leg each may include an electrode interface with a tapered fit corresponding to a shape of the first electrode and the second electrode respectively. Desirably, a portion of the heater bar combines in electrical communication with electrodes and/or an electrical bus, such as a first electrode corresponding to the first arm, and a second electrode corresponding to a second arm. The electrical bus may be water cooled. The electrical bus may include copper, aluminum, steel, other conductive materials, and/or the like. According to one embodiment, the first electrode and the second electrode each include a water-filled electrical conductor, such as an inverted or upside down U-shape and/or a hairpin.

The heater bar and the electrical bus may contact in any suitable manner, such as with a tapered fit to ensure intimate physical contact. According to one embodiment, the elongated heater bar includes a generally rectangular taper-lock terminal at the first end for electrically connecting the first leg to the first electrode and the second leg to the second electrode. Desirably, but not necessarily, the terminal may be larger in width or diameter than the arm of the heater bar. The taper may include any suitable angle, such as between about 0.5 degrees and about 10 degrees, about 2 degrees, and/or the like.

Electrode broadly refers to a conductor used to establish electrical contact with a refractory part of a circuit, such as the heater bar to the bus. The electrode may include any suitable size and/or shape. According to one embodiment, the electrode includes a generally C-shape with a taper fit, such as for receiving a portion of the electrode interface with a corresponding taper fit. The electrical supply may be at any suitable location, such as on a back or outside of the C-shape with a generally vertical orientation and a U-bend located on top of the two electrical conductors, for example.

The heater bar may be secured in the apparatus or the assembly by any suitable mechanism, such as a first compression plate securing the first arm and the first electrode, and a second compression plate securing the second arm and the second electrode. The compression plate may include any suitable shape, such as generally rectangular. The compression plate may be secured with any suitable device, such as one or more screws, fasteners, and/or the like. The compression plate may be an insulating and/or a conducting material. The compression plate may apply a force and/or a pressure upon or to a portion of the heater bar, such as to engage and or squeeze the taper-lock or taper fit.

The apparatus may further include an insulating insert disposed or positioned in or between the first arm and the second arm at or near the first end of the elongated heater bar. The insulating insert may include any suitable size and/or shape. The insulating insert may assist and/or aid in keeping the first terminal from contacting the second terminal, such as by maintaining the slot width. The insulating insert may include any suitable material, such as alumina, a high temperature electrical insulator, and/or the like. The insulating insert may include a generally hollow cylindrical shape, a tube, and/or the like. The insulating insert may include any suitable length, such as about a length of the terminal. Desirably, the insulating insert slides into a corresponding aperture formed at least in part by the first terminal and the second terminal, such as generally in an axial center of the heater bar. The insulating insert may be at least partially compressed or squeezed by the compression plates and/or the electrode interface, such as to assist in the taper fit.

The apparatus may further include an insulating sleeve or collar disposed or positioned over and/or along a portion of the elongated heater bar at or near the first electrode and the second electrode. The insulating sleeve may include any suitable size and/or shape. The insulating sleeve may assist and/or aid in keeping the heater bar electrically and/or thermally isolated, such as from a wall of the furnace formed by one or more layers of insulation. The insulating sleeve may include any suitable material, such as alumina, a high temperature electrical insulator, and/or the like. The insulating sleeve may include a generally hollow cylindrical shape, a tube, and/or the like. The insulating insert may include any suitable length, such as about a length of between about 1 width or diameter of the heater bar to about 5 widths or diameters of the heater bar, about 2.5 widths or diameters of the heater bar, and/or the like. Desirably, the insulating sleeve extends to the electrode, the terminal, and/or near the first end.

The apparatus may further include a generally cube-shaped electrode cover box, such as to protect and/or isolate at least a portion of the electrodes outside of the furnace. The cover box may include any suitable size and/or shape, such as a generally five sided box with the sixth side open for access to the device. The open side may have any suitable location, such as facing opposite the inside of the furnace. The side opposite the open side may include an opening, such as for passing at least a portion of the heater assembly into the furnace. The cover box may include one or more flanges or tabs disposed along a perimeter of the open side, for example. The cover box may contain or hold at least a portion of the terminals, electrodes, electrical bus and/or the like. The cover box may be made from any suitable material, such as steel. Desirably, but not necessarily, the electrical connections pass through a bottom of the cover box, such as by individual holes. The cover box may include a door, a cover, a hatch, and/or the like.

The apparatus of this invention may include a heater with any suitable resistance, such as less than about 5.0 ohms, less than about 1.0 ohm, less than about 0.1 ohms, less than about 0.03 ohms, about 0.0259 ohms, at least about 0.001 ohms, and/or the like.

The apparatus of this invention may include a heater with any suitable voltage, such as between about 10 volts and about 1,000 volts, between about 20 volts and about 60 volts, about 36 volts, and/or the like.

The apparatus of this invention may include a heater with any suitable amperage (current flow), such as between about 10 amps and about 5,000 amps, between about 500 amps and about 2,500 amps, about 1,389 amps, and/or the like.

The apparatus of this invention may include a heater with any suitable power output, such as between about 1 kilowatt and about 1,000 kilowatts, between about 10 kilowatts and about 100 kilowatts, about 50 kilowatts, and/or the like.

The apparatus of this invention may include a heater with any suitable power supply, such as direct current, alternating current, and/or the like. The alternating current may include any suitable frequency or cycles, such as between about 20 hertz and about 100 hertz, between about 40 hertz and about 80 hertz, about 60 hertz, and/or the like.

The apparatus of this invention may include any suitable life cycle, such as between about 1,000 hours and about 10,000 hours of operation before replacement of the heater element, between about 1,500 hours and about 5,000 hours of operation before replacement of the heater element, and/or the like of operation before replacement of the heater element.

The heating apparatus may be used in any portion or part of the casting process, such as in a melting step, in a holding or accumulating step, in a purification step, and/or in a solidification step. According to one embodiment, the heating apparatus is used for all steps in a casting process. In the alternative, separate heating apparatuses may be used for the individual steps of the casting process, such as with the pouring or transferring of molten feedstock between the vessels. The heating apparatus may be placed, located, and/or disposed in any suitable location, such as generally above a crucible or a vessel, generally below a crucible or a vessel, generally beside a crucible or a vessel, and/or the like.

According to one embodiment, the invention may include a heating apparatus suitable for use in casting high purity silicon. The apparatus may include a monolithic graphite elongated heater bar with a length, a first end with a generally rectangular taper-lock terminal, a second end opposite the first end, a generally circular cross section, and a diameter of between about 10 centimeters to about 15 centimeters. The apparatus may also include a slot across the diameter beginning at the first end and running a portion of the length, and the slot dividing the heater bar into a first arm and a second arm. The apparatus may also include an elbow at the second end joining the first arm and the second arm together and 5 longitudinal slits along each a portion of a length of the first arm and a length of the second arm. The apparatus may also include a first electrode with a first hairpin water-filled electrical conductor in electrical communication with the first arm by a tapered fit with the terminal, and a second electrode with a second hairpin water-filled electrical conductor in electrical communication with the second arm by a tapered fit with the terminal. The apparatus may also include a first compression plate securing the first arm and the first electrode, and a second compression plate securing the second arm and the second electrode. The apparatus may also include an insulating insert disposed between the first arm and the second arm at the first end of the elongated heater bar. The apparatus may also include an insulating sleeve disposed over a portion of the elongated heater bar near the first electrode and the second electrode, and isolating the heater bar from furnace insulation layers.

As used herein the terms "having", "comprising", and "including" are open and inclusive expressions. Alternately, the term "consisting" is a closed and exclusive expression. Should any ambiguity exist in construing any term in the claims or the specification, the intent of the drafter is toward open and inclusive expressions.

Regarding an order, number, sequence and/or limit of repetition for steps in a method or process, the drafter intends no implied order, number, sequence and/or limit of repetition for the steps to the scope of the invention, unless explicitly provided.

According to one embodiment, this invention may include a method of heating a furnace volume suitable for use in producing high purity silicon. The method may include the step of supplying an electrical current from an electrical source through a first electrical conductor. Supplying electrical current broadly includes providing electrical energy with sufficient voltage and/or current. The electrical source may include a plug, a connector and/or any other suitable local or distributed power supply or grid. The electrical conductor may include any suitable conduit and/or wire for transmitting or transporting electricity. According to one embodiment, the electrical conductor includes a water cooled tube or conduit, such as copper.

The method may also include the step of flowing the electrical current from the electrical conductor through a first electrode. Flowing electrical current broadly refers to passing electricity from one portion to another portion, such as from one end to another end of an object or a device. The method may also include the step of flowing the electrical current from the first electrode through a first arm of a single-piece elongated heater bar and resistance heating at least a portion of the furnace volume. The resistance heating may occur as power from the electricity is transformed into heat while the current encounters resistance traveling down or along a flow path.

The method may also include the step of flowing the electrical current from the first arm through an elbow of the elongated heater bar, such as to generally change a direction of the current by about 180 degrees or the opposite direction. The method may also include the step of flowing the electrical current from the elbow through a second arm of the elongated heater bar and resistance heating at least a portion of the furnace volume. The method may also include the steps of flowing the electrical current from the second arm through a second electrode, and the step of flowing the electrical current from the second electrode through a second electrical conductor, such as a return to the electrical supply or to a common ground.

According to one embodiment, the method may also include the step of adjusting or tuning a surface area of the elongated heater bar with one or more grooves or slits. In the alternative, the method may also include the step of adjusting or tuning a resistance value of the elongated heater bar with one or more grooves or slits. Desirably, the step of resistance heating warms, melts, heats (increases temperature and/or internal energy), superheats, and/or the like. The resistance heating may warm high purity silicon, silicon feedstock, and/or the like. The resistance heating may also warm or heat the furnace, the crucible, the associated equipment, and/or the like. Resistance heating desirably causes the heater bar to glow and transfer energy, such as by radiation to the surroundings or line-of-sight.

The resistance heating may include temperature control and variable power output, such as cycling from an on position and an off position, changing a current flow, changing a voltage applied, and/or the like.

According to one embodiment, the invention may include a method of operating a furnace heater suitable for use in producing high purity silicon. The method may include the step of energizing a heater element to heat a furnace volume with an electrical supply, such as engaging a switch or a contactor. The furnace volume broadly refers to the internal contents of the furnace, such as a crucible and a charge of feedstock. The method may also include the step of operating the heater element until failure, such as by an electrical short circuit or open circuit. The method may also include the step of denergizing the electrical supply, such as to prevent electrocution and/or shock. Optionally, but not necessarily, the method may include the step of cooling down the furnace and/or replacing an inert atmosphere with air. Optionally the method may include the step of opening a cover from a cover box, or the step of removing a cover from a cover box.

The method may also include the steps of removing a first compression plate on a first electrode and removing a second compression plate on a second electrode, such as unthreading two screws (fasteners) from each. With the compression plates removed, the heating element can be replaced, such as by the step of removing or pulling a single-piece elongated heater bar (failed element) from the furnace. The method may also include the step of inserting a second single-piece elongated heater bar into the furnace. The second elongated heater bar may be a new element. The method may also include the steps of installing the first compression plate on the first electrode and installing the second compression plate on the second electrode, such as threading two screws (fasteners) in each. The method may also include the step of reenergizing the electrical supply, such as to warm the volume of the furnace.

Desirably, the method may include where all steps are performed without entering the furnace, such as without inserting a hand or a tool within the volume of the furnace or casting station. Also the method may include where all steps are performed on a hot (at least above ambient conditions) furnace or casting station. Also the method may include where all steps are performed under or with an inert atmosphere within the furnace volume, such as argon, nitrogen and/or the like.

The method may also include the steps of installing an insulating sleeve over a portion of a first end of the elongated heater bar, and installing an insulating insert between a first portion of a terminal of the elongated heater bar and a second portion of a terminal of the elongated heater bar.

It will be apparent to those skilled in the art that various modifications and variations can be made in the disclosed structures and methods without departing from the scope or spirit of the invention. Particularly, descriptions of any one embodiment can be freely combined with descriptions or other embodiments to result in combinations and/or variations of two or more elements or limitations. Other embodiments of the invention will be apparent to those skilled in the art from consideration of the specification and practice of the invention disclosed herein. It is intended that the specification and examples be considered exemplary only, with a true scope and spirit of the invention being indicated by the following claims.

What is claimed is:

1. A heating apparatus suitable for use in producing high purity silicon, the apparatus comprising:

a single-piece elongated heater bar comprising a length, a first end, and a second end;

a slot beginning at the first end and running a portion of the length, and the slot dividing the heater bar into a first arm and a second arm;

an elbow at the second end joining the first arm and the second arm together allowing all electrical connections to be made at the first end;

a first electrode in electrical communication with the first arm;

a second electrode in electrical communication with the second arm;

a first compression plate securing the first arm and the first electrode; and a second compression plate securing the second arm and the second electrode.

2. The apparatus of claim 1, wherein the elongated heater bar comprises carbon, graphite, carbon-bonded carbon fiber, or silicon carbide.

3. The apparatus of claim 1, wherein the elongated heater bar comprises a width or diameter of between about 5 centimeters to about 25 centimeters.

4. The apparatus of claim 1, wherein the elongated heater bar comprises a width or a diameter of between about 10 centimeters to about 15 centimeters.

5. The apparatus of claim 1, wherein the elongated heater bar comprises one or more grooves along a portion of the length.

6. The apparatus of claim 1, wherein the elongated heater bar comprises one or more longitudinal slits through a first leg or a second leg.

7. The apparatus of claim 1, wherein the first arm and the second arm each comprise 5 grooves or slits along a portion of a length of the first arm and a length of the second arm.

8. The apparatus of claim 1, wherein the elongated heater bar comprises a generally circular cross section.

9. The apparatus of claim 1, wherein the slot divides the elongated heater bar across a width or a diameter.

10. The apparatus of claim 1, wherein a first leg and a second leg each comprise an electrode interface with a tapered fit corresponding to a shape of the first electrode and the second electrode respectively.

11. The apparatus of claim 1, wherein the elongated heater bar comprises a generally rectangular taper-lock terminal at the first end for electrically connecting a first leg to the first electrode and a second leg to the second electrode.

12. The apparatus of claim 1, wherein the first electrode and the second electrode each comprise a water-filled electrical conductor.

13. The apparatus of claim 1, further comprising an insulating insert disposed between the first arm and the second arm at the first end of the elongated heater bar.

14. The apparatus of claim 1, further comprising an insulating sleeve disposed over a portion of the elongated heater bar near the first electrode and the second electrode.

15. The apparatus of claim 1, further comprising an insulating sleeve disposed over a portion of the elongated heater bar isolating the heater bar from furnace insulation layers.

16. The apparatus of claim 1, wherein the elongated heater bar is machined from a monolithic block or cylinder.

17. A heating apparatus suitable for use in casting high purity silicon, the apparatus comprising:

a monolithic graphite elongated heater bar comprising a length, a first end with a generally rectangular taper-lock terminal, a second end opposite the first end, and a diameter of between about 10 centimeters to about 15 centimeters;

a slot across the diameter beginning at the first end and running a portion of the length, and the slot dividing the heater bar into a first arm and a second arm;

an elbow at the second end joining the first arm and the second arm together;

5 longitudinal slits along each a portion of a length of the first arm and a length of the second arm;

a first electrode with a first hairpin water-filled electrical conductor in electrical communication with the first arm by a tapered fit with the terminal;

a second electrode with a second hairpin water-filled electrical conductor in electrical communication with the second arm by a tapered fit with the terminal;

a first compression plate securing the first arm and the first electrode;

a second compression plate securing the second arm and the second electrode;

an insulating insert disposed between the first arm and the second arm at the first end of the elongated heater bar; and an insulating sleeve disposed over a portion of the elongated heater bar near the first electrode and the second electrode, and isolating the heater bar from furnace insulation layers.

18. A method of heating a furnace volume suitable for use in producing high purity silicon, the method comprising:

supplying an electrical current from an electrical source through a first electrical conductor;

flowing the electrical current from the electrical conductor through a first electrode;

flowing the electrical current from the first electrode through a first arm of a single-piece elongated heater bar and resistance heating at least a portion of the furnace volume;

flowing the electrical current from the first arm through an elbow of the elongated heater bar;

flowing the electrical current from the elbow through a second arm of the elongated heater bar and resistance heating at least a portion of the furnace volume;

flowing the electrical current from the second arm through a second electrode; and flowing the electrical current from the second electrode through a second electrical conductor;

wherein the first arm and the first electrode are secured by a first compression plate and the second arm and the second electrode are secured by a second compression plate.

19. The method of claim 18, further comprising adjusting a surface area of the elongated heater bar with one or more grooves or slits.

20. The method of claim 18, further comprising adjusting a resistance value of the elongated heater bar with one or more grooves or slits.

21. The method of claim 18, wherein the resistance heating warms, melts, or superheats high purity silicon.

22. A method of operating a furnace heater suitable for use in producing high purity silicon, the method comprising:

energizing a heater element to heat a furnace volume with an electrical supply;

operating the heater element until failure;

denergizing the electrical supply;

removing a first compression plate on a first electrode;

removing a second compression plate on a second electrode;

removing a single-piece elongated heater bar from the furnace;

inserting a second single-piece elongated heater bar into the furnace;

installing the first compression plate on the first electrode;

installing the second compression plate on the second electrode; and reenergizing the electrical supply.

23. The method of claim 22, wherein all steps are performed without entering the furnace.

24. The method of claim 22, wherein all steps are performed on a hot furnace.

25. The method of claim 22, further comprising:

installing an insulating sleeve over a portion of a first end of the elongated heater bar; and installing an insulating insert between a first portion of a terminal of the elongated heater bar and a second portion of a terminal of the elongated heater bar.

26. A heating apparatus suitable for use in producing high purity silicon, the apparatus comprising:

a single-piece elongated heater bar comprising a length, a first end, and a second end;

a slot beginning at the first end and running a portion of the length, and the slot dividing the heater bar into a first arm and a second arm;

an elbow at the second end joining the first arm and the second arm together allowing all electrical connections to be made at the first end;

a first electrode in electrical communication with the first arm;

a second electrode in electrical communication with the second arm; and a first leg and a second leg, wherein each of the first leg and the second leg comprise an electrode interface with a tapered fit corresponding to a shape of the first electrode and the second electrode respectively.

27. A heating apparatus suitable for use in producing high purity silicon, the apparatus comprising:

a single-piece elongated heater bar comprising a length, a first end, and a second end;

a slot beginning at the first end and running a portion of the length, and the slot dividing the heater bar into a first arm and a second arm;

an elbow at the second end joining the first arm and the second arm together allowing all electrical connections to be made at the first end;

a first electrode in electrical communication with the first arm;

a second electrode in electrical communication with the second arm; and a first leg and a second leg, wherein the elongated heater bar comprises a generally rectangular taper-lock terminal at the first end for electrically connecting the first leg to the first electrode and the second leg to the second electrode.

* * * * *